United States Patent [19]

Burgess et al.

[11] Patent Number: 4,627,276

[45] Date of Patent: Dec. 9, 1986

[54] METHOD FOR MEASURING BIT WEAR DURING DRILLING

[75] Inventors: Trevor M. Burgess; William G. Lesso, Jr., both of Missouri, Tex.

[73] Assignee: Schlumberger Technology Corporation, New York, N.Y.

[21] Appl. No.: 686,851

[22] Filed: Dec. 27, 1984

[51] Int. Cl.[4] ..... E21B 12/00

[52] U.S. Cl. ..... 73/151; 175/39

[58] Field of Search ..... 73/151.5, 151, 84, 104; 175/39, 50

[56] References Cited

U.S. PATENT DOCUMENTS

| | | | |
|---|---|---|---|
| Re. 28,436 | 6/1975 | Vitter | 73/151 |
| 2,096,995 | 10/1937 | Mizell | 73/151.5 |
| 2,372,576 | 3/1945 | Hayward | 73/152 |
| 2,669,871 | 3/1949 | Lubinski | 73/151 |
| 3,345,867 | 10/1967 | Arps | 73/151 |
| 3,581,564 | 6/1971 | Young | 73/151 |
| 3,774,445 | 11/1973 | Rundell | 73/151 |
| 3,782,190 | 1/1974 | Pittman | 175/39 |
| 3,898,880 | 8/1975 | Kelseaux et al. | 73/151.5 |
| 4,064,749 | 12/1977 | Pittman | 73/152 |

FOREIGN PATENT DOCUMENTS

| | | | |
|---|---|---|---|
| 3100984 | 7/1982 | Fed. Rep. of Germany . | |
| 0156312 | 12/1981 | Japan | 73/84 |

OTHER PUBLICATIONS

T. M. Warren, Factors Affecting Torque for a Roller Cone Bit, Sep. 1984, pp. 1500–1508, "Journal of Petroleum Technology".

*Primary Examiner*—Stewart J. Levy
*Assistant Examiner*—Robert R. Raevis

[57] ABSTRACT

A method for measuring the wear of milled tooth bits during oilwell drilling uses surface and subsurface wellsite sensors to determine averaged values of penetration rate, rotation speed and MWD (measurements-while-drilling) values of torque and weight-on-bit to obtain a real time measurement of tooth wear, drilling efficiency and the in situ shear strength of the rock being drilled.

4 Claims, 8 Drawing Figures

THE ACTION OF A SINGLE BLUNT TOOTH.

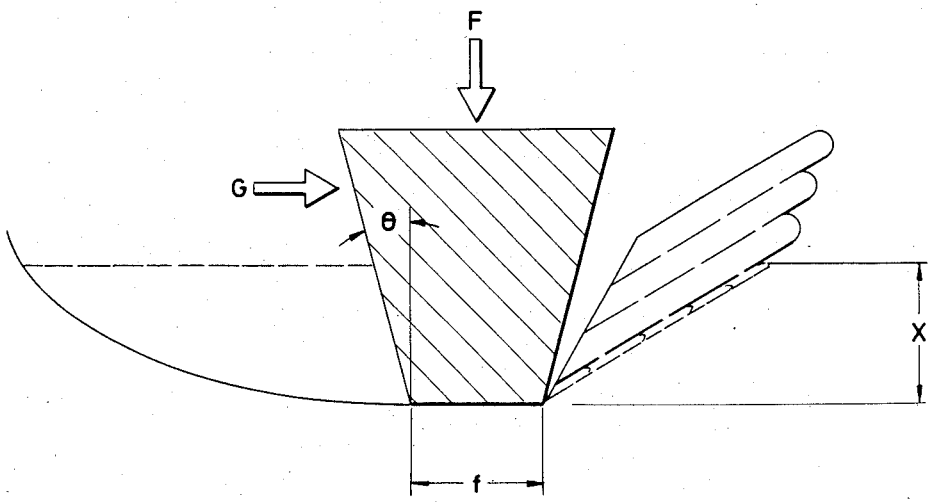
FIG. 1 THE ACTION OF A SINGLE BLUNT TOOTH.
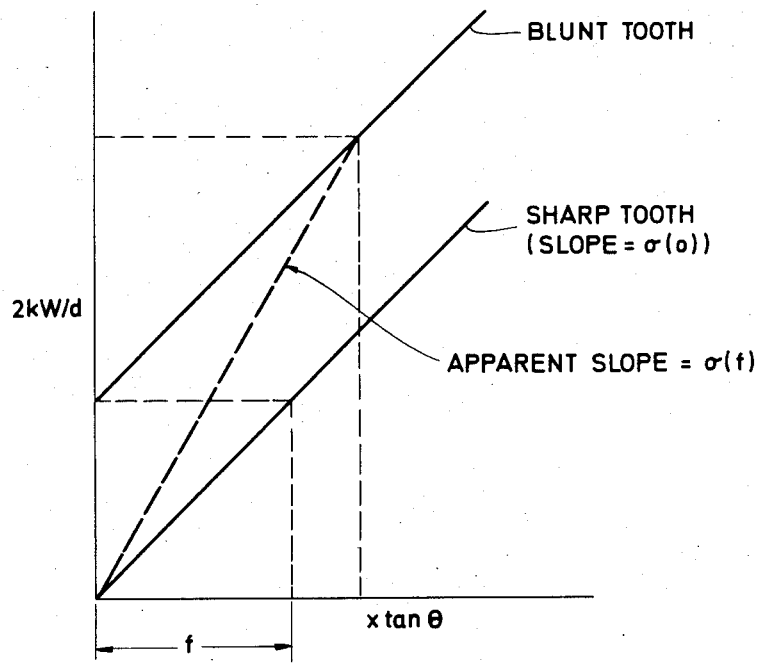
FIG. 2 FORCE-PENETRATION RELATIONSHIP FOR A WEDGE-SHAPED INDENTOR.

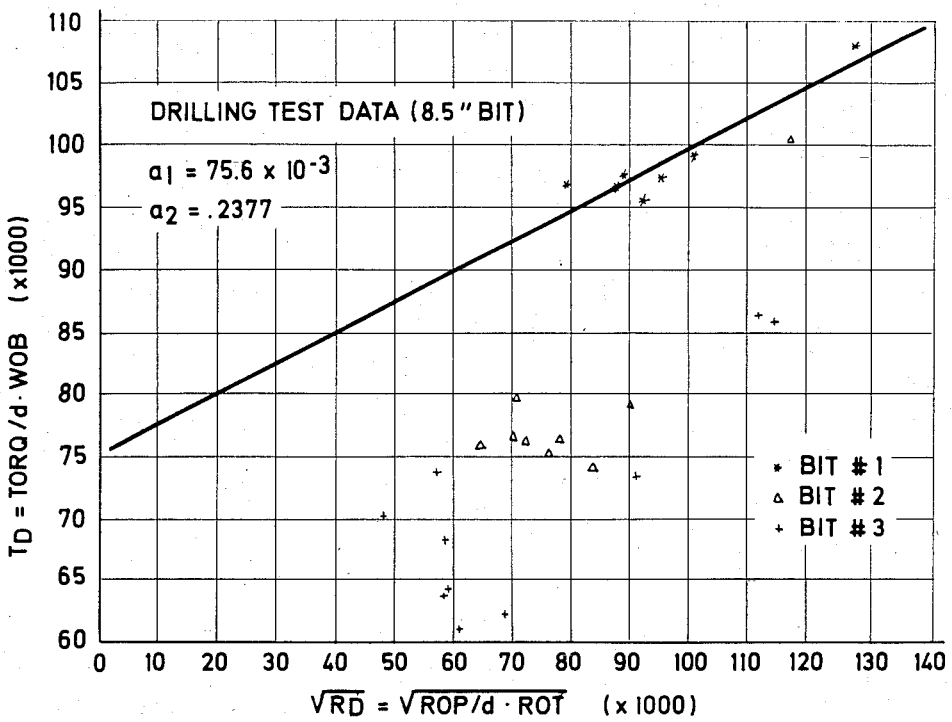
*FIG.3* CROSS PLOT OF $T_D$ AND $\sqrt{R_D}$ FOR PIERRE SHALE DRILLING TEST
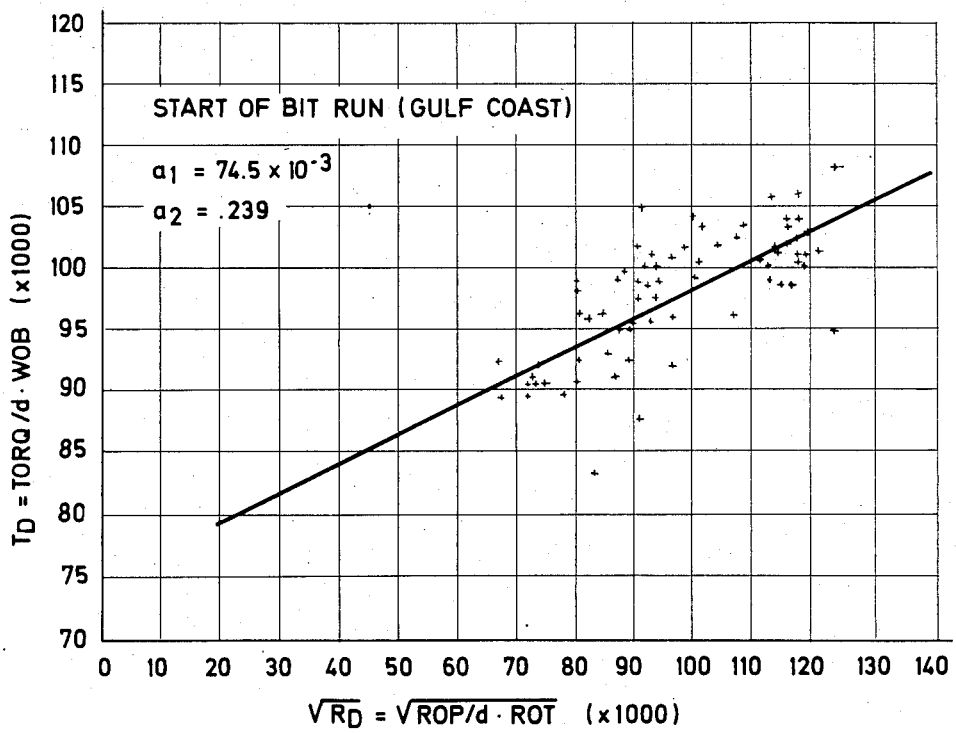
*FIG.6* CROSS PLOT OF $T_D$ AND $\sqrt{R_D}$ FOR THE START OF A NEW BIT RUN ON A GULF COAST WELL

LOG OF MEASURED DATA FROM PIERRE SHALE DRILLING TEST

MECHANICAL EFFICIENCY LOG COMPUTED FROM PIERRE SHALE DRILLING TEST DATA.

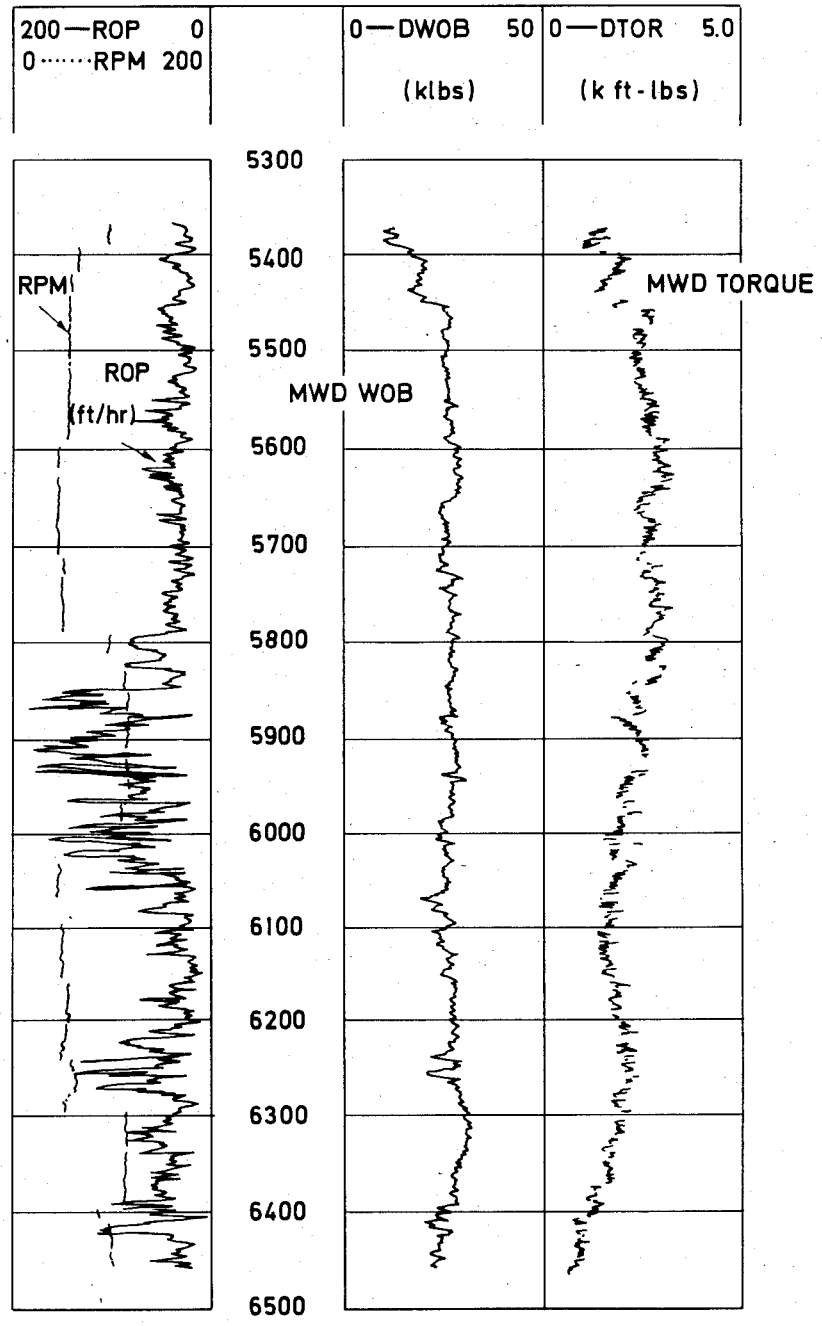
*FIG. 7* LOG OF MWD DATA FROM A BIT RUN ON A GULF COAST WELL.

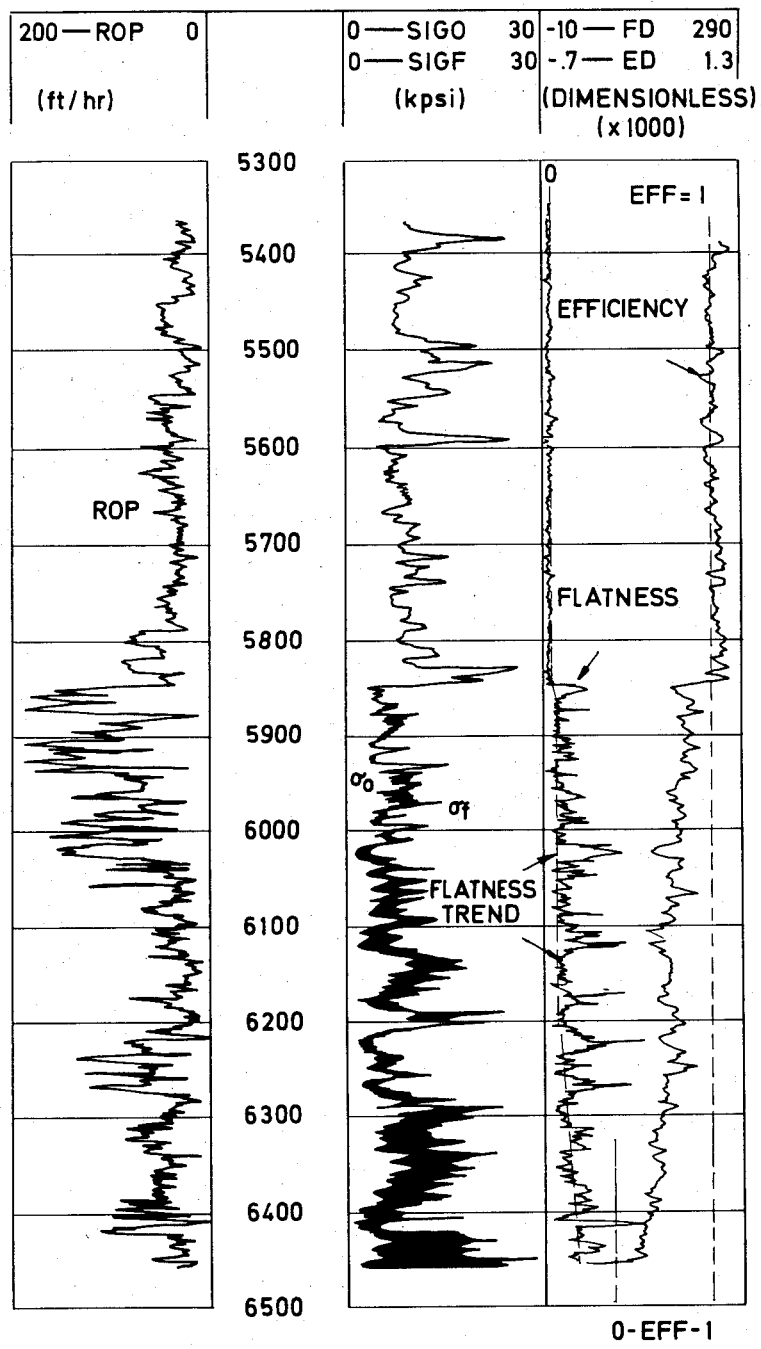
FIG. 8 MECHANICAL EFFICIENCY LOG COMPUTED FROM A BIT RUN ON A GULF COAST WELL.

METHOD FOR MEASURING BIT WEAR DURING DRILLING

BACKGROUND OF THE INVENTION

1. Field of the Invention

The invention relates to a method for the real time measurement of bit wear during oilwell drilling.

2. Background Information

In T. Warren, "Factors Affecting Torque for a Roller Cone Bit," appearing in *Jour. Pet. Tech.* (September 1984), Volume 36, pages 1500–1508, a model was proposed for the torque of a roller cone bit. The model was derived from the theory of the rolling resistance of a wheel or cutter. For a pure rolling action, without bearing friction, the model shows that $$M = a_2\sqrt{R/(Nd)}\ Wd \tag{1}$$

where M is the time averaged torque required to rotate the bit under steady state conditions, R is the rate of penetration, N is the rotary speed of the bit, W is the axial force applied to the bit, and d is the bit diameter. $a_2$ is a dimensionless constant that is determined by the bit geometry, and in principle, is independent of rock properties.

Soft formation bits have cones that are not true geometrical cones, and the axes of the cones are offset from the center of the bit. These two measures create a large degree of gouging and scraping in the cutting action of the bit. This effect is taken into account by adding another dimensionless bit constant, $a_1$, to the model $$M = [a_1 + a_2\sqrt{R/(Nd)}\ ]\ Wd \tag{2}$$

In practice, the constant $a_1$ includes the effect of bearing friction. This contributes less than 10% of the total bit torque under typical operating conditions.

Generally $a_1$ has a much greater value for soft formation bits than for hard formation bits because of the longer teeth and the gouging action. $a_2$ is generally greater for hard formation bits than for soft formation bits because hard formation bits drill by a rolling action that crushes and grinds the rock.

Warren confirmed the validity of the model (2) on both field and laboratory data and showed that it is insensitive to moderate changes in factors such as bit hydraulics, fluid type and formation type. This does not mean that rock properties do not affect torque, but rather than the effect of rock properties on bit torque is sufficiently accounted for by the inclusion of penetration per revolution, R/N, in the torque model.

SUMMARY OF THE INVENTION

In field tests with MWD tools, the observed torque was found to systematically decrease from its expected value with distance drilled. This phenomenon has also been observed by Applicants in a large number of examples, particularly with drilling clays, shales, or other soft formations that tend to deform plastically under the bit. It appears to be associated with bit tooth wear.

The reduction of bit torque with tooth wear corresponds to a change in one or both of the coefficients $a_1$, $a_2$. A reduction in tooth length results in a tooth flat, or blunting. This gives rise to less tooth penetration and consequently reduces the gouging and scraping action of the bit. As a result Applicants expect a significant reduction in $a_1$ with tooth wear. However, an even reduction in tooth length does not greatly alter the geometry of the cones. Thus, Applicants do not expect a large variation in $a_2$ and make the assumption that it remains constant.

BRIEF DESCRIPTION OF THE DRAWINGS

FIG. 1 is a schematic illustrating the action of a single blunt tooth.

FIG. 2 shows the force-penetration relationship for a wedge-shaped indentor.

FIG. 3 shows a cross plot of $T_D$ and $\sqrt{R_D}$ for Pierre shale drilling test.

FIG. 6 shows a cross plot of $T_D$ and $\sqrt{R_D}$ for the start of a new bit run on a Gulf Coast well.

FIG. 7 shows a log of MWD data from a bit run on a Gulf Coast well.

FIG. 8 shows a drilling efficiency log computed from a bit run on a Gulf Coast well.

DESCRIPTION OF PREFERRED EMBODIMENTS

Figure 4:
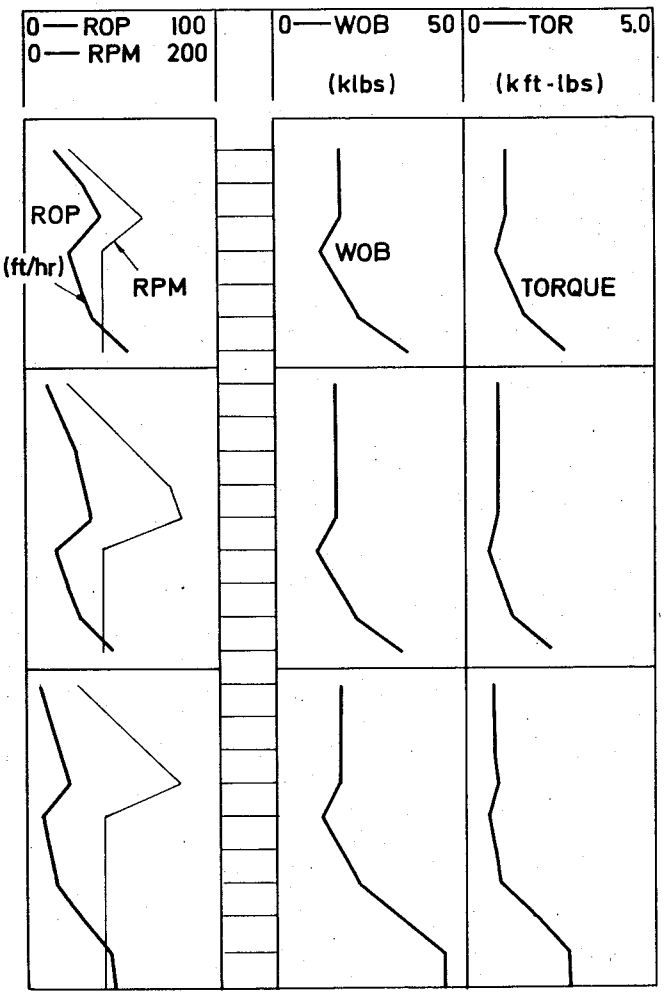
FIG. 4 shows a log of measured data from Pierre shale drilling test.

In the appendix a simple set of analytical drilling equations is derived using a few assumptions about the physical processes involved in drilling. The equations are primarily intended for milled tooth bits drilling formations that deform plastically under the bit.

For simplicity, the drilling equations are given in dimensionless terms which are defined as:

| | | |
|---|---|---|
| $T_D = M/(Wd)$ | the dimensionless torque | (3) |
| $R_D = R/(Nd)$ | the dimensionless penetration rate | (4) |
| $E_D = \sigma/\sigma(f)$ | the dimensionless bit efficiency | (5) |
| $W_D = 2W/(\sigma d^2)$ | the dimensionless weight-on-bit | (6) |
| $F_D = f/(kd)$ | the dimensionless tooth flat | (7) |

where f is the average or effective tooth flat (see FIG. 1), $\sigma$ is the effective rock shear strength (as defined in the appendix), and $\sigma(f)$ is a function which represents the apparent strength of the rock to a bit with average tooth flat f. $\sigma(f)$ is always greater than $\sigma$, and $\sigma(0)$ equal $\sigma$. $\sigma$ is a measure of the in situ shear strength of the rock, and as such is noramlly considered to be a function of the rock matrix, the porosity, and the differential pressure between the mud and the pore fluids. $\sigma$ is the slope of the force penetration curve when a sharp wedge shaped indentor is pushed into a rock (see FIG. 2). For a blunt tooth, the force penetration curve is displaced so that a threshold force is needed before penetration can begin. For a given axial load, $\sigma(f)$ is the slope from the origin to the appropriate point on the force penetration curve. k is related to the number of tooth rows on the bit that bear the load at any one time. Typically k is of the order of 1 to 4.

In theory, $E_D$ is a positive value less than 1. For a sharp bit, $E_D$ is equal to 1. As wear occurs, $E_D$ decreases. $E_D$ also decreases as the rock becomes harder. It can be increased by increasing the weight-on-bit.

The drilling equations are readily expressed in terms of the dimensionless terms (3) to (7) as $$T_D = a_1 E_D + a_2 \sqrt{R_D} \quad (8)$$

$$W_D = R_D/(4a_1 E_D) \quad (9)$$

$$F_D = W_D(1 - E_D) \quad (10)$$

where $a_1$ and $a_2$ are the coefficients of equation (2) determined for a sharp bit.

Equation (8) is equivalent to (2) with the efficiency term $E_D$ accounting for the wear. Equation (8) does not define a straight line of $T_D$ versus $R_D$ since $E_D$ depends upon W when the bit is blunt. This means that $a_1$ and $a_2$ can only be determined by empirical methods when data come from a sharp new bit.

Equation (10) shows how the tooth flat is connected with the efficiency $E_D$. Equation (9) shows how the penetration rate is related to the weight-on-bit and tooth wear.

In practice, W and M are the downhole values of weight-on-bit and bit torque as measured by a measurements while drilling (MWD) system. The constants $a_1$ and $a_2$ are determined from a cross-plot of $T_D$ versus $\sqrt{R_D}$ for data coming from a sharp bit, or from previously tabulated values. Then the other terms are computed on a foot by foot basis as follows:

(i) compute $T_D$ and $R_D$
(ii) solve (8) for $E_D$
(iii) solve (9) for $W_D$
(iv) compute $\sigma(0)$ and $\sigma(f)$ from (5) and (6)
(v) compute $F_D$ from (10) and f from (7)

The computed data displayed in the form of a drilling log is called the Mechanical Efficiency Log.

The appendix describes a simple way of including in the model the effects of friction between the teeth flats and the rock. It amounts to an adjustment of $E_D$ as follows:

$$E_D \text{ becomes } [E_D - \mu \tan\theta]/[1 - \mu \tan\theta]$$

where $\mu$ is the coefficient of friction between the rock and the teeth flats and $\theta$ is the semi-angle of the bit teeth (see FIG. 2).

EXAMPLES

(i) Laboratory Study

Three similiar cores of Pierre Shale were drilled with 8.5 inch IADC 1-3-6 type bits under controlled laboratory conditions. The first core was drilled with a new bit (teeth graded T0) using seven different sets of values of weight-on-bit and rotary speed. The second and third cores were drilled with field worn bits of the same type using nine and ten different sets of values of weight-on-bit and rotary speed respectively (see FIG. 4). The bit used to drill the second core was half worn and graded T2 to T4. The bit used to drill the third core was more worn and graded T5 to T7 depending upon the assessor. We shall call the new bit #1; the second bit #2 bit; and the most worn bit #3 bit. The bearings of the worn bits were considered to be in very good working order. Each set of values of weight-on-bit and rotary speed was maintained for about 30 seconds on average. In each test the mud flow rate was kept constant at 314 gal./min. (1190 l/min.) and the borehole pressure at 2015 psi (13.9 MPa). An isotropic stress of 2100 psi (14.5 MPa) was applied to the boundaries of the cores.

FIG. 3 shows a cross-plot of M/(Wd) versus the square root of R/(Nd) for the three different bits. The new bit defines a reasonable straight line with intercept ($a_1$) $7.56\times10^{-2}$ and slope ($a_2$) 0.238 (determined from a least-squares fit). The relatively low slope is typical of an IADC series 1 bit.

Data corresponding to the #2 and #3 bits lie beneath the line. This clearly demonstrates the reduction in M/(Wd) or $a_1$ with wear.

A computer processed interpretation of the data was made using the technique descibed above with the following parameters.

$a_1 = 7.56\times10^{-2}$
$a_2 = 0.238$
$\mu = 0.3$
$\theta = 20°$

Figure 5:
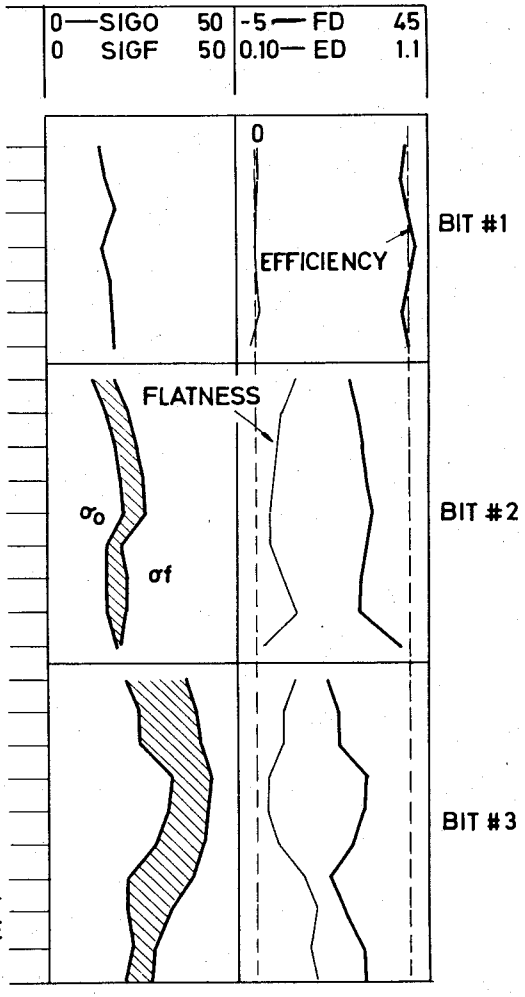
FIG. 5 shows a drilling efficiency log computed from Pierre shale drilling test data.

Logs of the effective rock shear strength, $\sigma(0)$, and $\sigma(f)$ are shown in FIG. 5 with the drilling efficiency, $E_D$, and the dimensionless tooth flat, $F_D$.

The efficiency of the new bit, $E_D$, is seen to be close to 1. On average the efficiency of the #2 bit is seen to be less than the #1 bit, and the efficiency of the #3 less than the #2 bit. For each bit the efficiency is maximized when the weight-on-bit is greatest. Although the change in $E_D$ from the #2 to the #3 bit was not as much as might have been expected, the overall trend is clear. It suggests that the initial wear of bit teeth has a greater effect than additional wear at a later stage in the life of the bit.

The dimensionless tooth flat shows some point to point variation. This arises from inaccuracies in the model when the input weight-on-bit and rotary speed are varied right across the commercial range.

The logs of $\sigma(0)$ and $\sigma(f)$ clearly show how the apparent rock strength to a blunt bit increases with wear, and how $\sigma(f)$ can be reduced by increasing the weight-on-bit.

The interpretation of $\sigma(0)$ shows that the in situ strengths of the two first cores were fairly consistent at about 17.5 kpsi (121 MPa), and that the third core appeared to be somewhat stronger, particularly in the central portion.

In practice, field variations in weight-on-bit and rotary speed are much smaller than those used in the drilling test and better results can be expected. Sample points corresponding to a weight-on-bit of 21.5 klbs (120 kN) and a rotary speed of 80 RPM are indicated in FIG. 5. These points clearly show the effect of wear on a given rock when input drilling parameters are kept constant. The results are summarized below.

| | #1 | #2 | #3 |
|---|---|---|---|
| $E_D$ | 1.0 | 0.74 | 0.56 |
| $F_D$ | 0 | 9.9 | 12.5 |
| f (ins) | 0 | 0.25 | 0.32 |

The values of f were computed using k=3.

(ii) Field Example with MWD

FIG. 7 is a log of drilling data from a single bit run through a shale sand sequence in the Gulf Coast of the U.S.A. The bit was a new IADC 12¼ inch 1-1-6 type bit and was pulled out of the hole with almost all the teeth worn away. The data shown in FIG. 7 are the downhole weight-on-bit, the downhole torque, the rotary speed (as measured at the surface) and the rate of penetration calculated over intervals of five feet. The downhole weight-on-bit and the downhole torque were measured using an MWD tool placed in the bottom hole assembly above the bit, a near bit stabilizer, and one drill collar.

$T_D$ and $R_D$ were first computed on a foot by foot basis. Then in order to determine $a_1$ and $a_2$ a cross-plot was made of the data from 5410–5510 feet (FIG. 6). The data from the 5365 to 5409 feet were ignored in the determination of $a_1$ and $a_2$ because the MWD tool was about 50 feet above the bit and would record the torque at the bit plus the torque at stabilizers between the MWD tool and the bit. In the course of pulling a bit and running a new bit, it is possible for the hole to swell, resulting in extra (MWD) torque until the stabilizers below the MWD tool are in the "fresh" hole.

Despite only small variations in weight-on-bit over the interval 5410–5510 feet, the cross-plot defines a reasonable straight line with intercept ($a_1$) $7.45\times10^{-2}$ and slope ($a_2$) 0.231 (determined by the least-square method, with a correlation coefficient of 0.74). The variation about the line is typical of the "noise" seen in field data. It is interesting to note that the calculated values of $a_1$ and $a_2$ are very similar to those obtained in the laboratory tests.

A computer processed interpretation of the data was made using the values of $a_1$ and $a_2$ above and a rock-/tooth friction coefficient $\mu=0.3$. Logs of the effective rock shear shrength $\sigma(0)$, and $\sigma(f)$ are shown in FIG. 8 with the drilling efficiency $E_D$, the dimensionless tooth flat, $F_D$, and the rate of penetration. The processed data were averaged over intervals of 5 feet to smooth out some of the noise.

Since the downhole weight-on-bit is fairly constant, the trend in the dimensionless efficiency, $E_D$, in the shales is a good measure of the state of wear of the bit. The efficiency is close to 1 until a sand section at about 5850 feet, when the efficiency drops off significantly and rapidly to just below 0.8. This also corresponds to a large increase in rotary speed. Thus we can assume that the combined effects of the sand and the high rotary speed resulted in some significant blunting of the sharp teeth. Below this depth the trend of $E_D$ is decreasing during the high RPM sections and more constant in the lower RPM sections. This clearly shows how wear rate is associated with rotation speed. The final average value of $E_D$ is about 0.26.

Those places where $E_D$ is greater than 1, or equivalently where $\sigma(f)$ is less than $\sigma(0)$, can be interpreted as places in which stabilizers between the MWD tool and the bit are rubbing against the formation. When these stabilizers lose a significant amount of torque the result is high $E_D$ and low $F_D$ values. Thus those places were the sharpness seems to suddenly increase, probably correspond to bit depths were stabilizers were rubbing the formation.

The interpretation of $F_D$ is similar to that of $E_D$ except that $F_D$ is more sensitive to the sand sections. Sand sections in this well are associated with high rates of penetration. A trend line has been drawn through the values of $F_D$ corresponding to the shales. If it is assumed that the tooth row factor k equals 3 in the shale sections, then the effective tooth flat is

| depth | f (ins) |
|---|---|
| 5800 | 0 |
| 5890 | .40 |
| 6160 | .66 |

-continued

| depth | f (ins) |
|---|---|
| 6370 | 1.14 |
| 6450 | 1.40 |

Clearly the final value of f is not very reliable because of the extreme nature of the wear.

A method has been presented for inferring the wear of soft formation milled tooth bits from MWD measurements of weight-on-bit and torque in formations that drill by a gouging and scraping action. The theory leads to an interpretation technique (Mechanical Efficiency Log) based on a simple measure of drilling efficiency, $E_D$.

For a new bit, $E_D$ is close to 1. As the teeth wear, $E_D$ decreases towards 0, however $E_D$ can be increased by increasing the weight-on-bit. From $E_D$ it is possible to compute a dimensionless tooth flat, $F_D$, that is proportional to the effective average flatness of the teeth. With knowledge of $E_D$ or $F_D$ it is possible to compute what the penetration rate would have been with a sharp bit and hence calculate the effective in situ shear strength of the rock.

The interpreted data are inherently variable as a result of the raw data, however the underlying trends observed in $E_D$ and $F_D$ in rock like shales appear to give a reliable indication of tooth wear. With improved data processing and further experience, it could become possible to accurately predict the wear of milled teeth bits in real time from MWD measurements of weight-on-bit and torque.

APPENDIX—DERIVATION OF DRILLING EQUATIONS

Suppose that the teeth on the bit penetrate the rock a distance, x, and that the bulk of drilling is achieved by the gouging and scraping action of the bit. The action of a blunt tooth is shown schematically in FIG. 1.

Assume that the force per unit length of tooth needed to gouge the rock in situ, G, is proportional to the depth of indentation.

$$G=\tau x \tag{A-1}$$

Equation A-1 is an approximation to the failure or penetration curves that can be observed in plastically deforming materials. In this paper, the constant of proportionality, $\tau$, is thought of as the effective in situ shear strength of the rock. If it is assumed that $\tau$ is independent of the tooth velocity, then the main factors affecting $\tau$ are the rock matrix, the differential pressure between the mud and the pore pressure, and the porosity.

In soft plastic rocks, we shall assume that all the penetration comes from gouging and scraping and that the chipping and crushing action is of minor importance. The penetration per revolution is then proportional to the depth of indentation.

$$R/N=Sx \tag{A-2}$$

The dimensionless constant S is proportional to the average gouging velocity of the bit teeth divided by the rotation speed. It is the proportion of the cross-sectional area of the hole that is cut to a depth x in one revolution of the bit.

If $M^1$ is the average torque expended on gouging, then the work done on gouging per revolution ($2\pi M^1$)

is proportional to $\tau$ and the cross-sectional area cut out in one revolution, $S\pi(d/2)^2$.

$$\Longrightarrow 2\pi M^1 = \tau x \pi S \pi (d/2)^2 \quad M^1 = S\tau x d^2/8 \tag{A-3}$$

It is interesting to note that equations (A-2) and (A-3) show that the specific energy expended in gouging, S.E., defined as $$S.E. = 2M^1 N/[(d/2)^2 R] \tag{A-4}$$

is equal to $\tau$, the effective shear strength of the rock.

Having established the relationship between $M^1$ and x, it is necessary to express x in terms of the axial load, W. For long milled tooth bits with intersecting teeth on different cones, the total axial load is distributed over approximately one bit radius. However the maximum force on a tooth occurs when that tooth row bears all the load, thus the average maximum force per width of tooth pushing into the rock, F, is given by:

$$F = kW/(d/2) \tag{A-5}$$

where k is a dimensionless number associated with the number of tooth rows. k is expected to take a value between 1 and 4.

For wedge shaped indentors penetrating plastically deforming materials, the force required to penetrate is approximately proportional to the cross-sectional area of the tooth in contact with the deforming material (see FIG. 2). For a blunt wedge that is loaded on the wedge flat and one face $$F = \sigma[f + x \tan\theta] \tag{A-6}$$

where f is the average tooth flat (shown schematically in FIG. 1), $\theta$ is the semi-tooth angle (typically 20°), and $\sigma$ is a constant of proportionality related to the rock strength. Note that when the tooth flat f is greater than zero, a threshold force of $\sigma$ f is required before indentation can begin.

Using equation (A-5) and (A-6)

$$x = \frac{2kW}{\tan\theta \cdot d\sigma}[1 - (d/2)f\sigma/kW] \tag{A-7}$$

If the function $\sigma$(f) is defined as follows $$\sigma(f) = \sigma/[1 - (d/2)f\sigma/kW] \tag{A-8}$$

then $$x = \frac{2kW}{\tan\theta \cdot d\sigma(f)} \tag{A-9}$$

$\sigma$(f) is the apparent strength of the rock as it appears to a blunt bit with average tooth flat, f, at a weight-on-bit of W. Clearly $\sigma$(f) is never smaller than $\sigma$, and $\sigma(0)$ equals $\sigma$. The dependency of $\sigma$(f) on W is such that the rock appears harder at low weight-on-bit than it does at high weight-on-bit (see FIG. 2).

Using equation (A-9) to eliminate x in equations (A-3) and (A-2) respectively $$M^1/(Wd) = [Sk/(4\tan\theta)][\tau/\sigma(f)] \tag{A-10}$$

$$dR/(8NW) = [Sk/(4\tan\theta)]/\sigma(f) \tag{A-11}$$

The ratio of these equations is the specific energy, $\tau$. Equation (A-10) describes how the coefficient $a_1$, varies with wear. For a new bit $$a_1 = [Sk/(4\tan\theta)][\tau/\sigma(0)] \tag{A-12}$$

This term depends upon the rock unless $\tau/\sigma$ is a constant.

From the definition of $\tau$(A-1) and $\sigma$(A-6)

$$G/F = \tau/(\sigma\tan\theta) \tag{A-13}$$

If we resolve forces along the workface of the tooth (see FIG. 1) and ignore friction between the rock and the tooth $$G/F = 1/\tan\theta \tag{A-14}$$

Combining (A-13) and (A-14) gives $$\tau = \sigma[=\sigma(0)]$$

Thus for a new bit, $a_1$ is predicted to be a constant, as observed experimentally by Warren[1].

Defining $E_D$ as $$E_D = \sigma(0)/\sigma(f) \tag{A-15}$$

the modified torque equation becomes $$T_D = a_1 E_D + a_2\sqrt{R_D} \tag{A-16}$$

$E_D$ can be thought of as the efficiency of the bit for a given rock type, tooth wear, and weight-on-bit. $E_D$ is equal to 1 for a new bit and then decreases with wear. It is less in hard rocks than in soft rocks. The efficiency of a worn bit can be increased by increasing the weight-on-bit.

Once $E_D$ is known, it is straightforward to compute the average tooth flat, f. From (A-8)

$$f = [2kW/(\sigma d)][1 - E_D] \tag{A-17}$$

If we define a dimensionless tooth flat, $F_D$, and a dimensionless weight-on-bit, $W_D$ by $$F_D = f/kd \tag{A-18}$$

$$W_D = 2W/(\sigma d^2) \tag{A-19}$$

we are left with the following simple set of drilling equations $$T_D = a_1 E_D + a_2\sqrt{R_D} \tag{A-20}$$

$$W_D = R_D/(4a_1 E_D) \tag{A-21}$$

$$F_D = W_D(1 - E_D) \tag{A-22}$$

where (A-21) comes from (A-11) and (A-22) from (A-17).

Once $a_1$ and $a_2$ are known for a new bit, it is possible to compute $T_D$ and $R_D$ on a foot by foot basis, then calculate $E_D$ from (A-20), $W_D$ from (A-21), and $F_D$ from (A-22).

Frictional Effects

It is a simple matter to add to the model the effect of friction between the flats of the worn teeth and the rock if the coefficient of friction is known. The force on the tooth flat in a direction perpendicular to the motion is the same as the threshold force needed for indentation, $\sigma f$. Suppose $\mu$ is the dynamic coefficient of friction between the teeth and the rock. Then equation (A-1) becomes $$G=\tau x+\mu\sigma f \quad \text{(A-23)}$$

Using this value of G in all the equations leading to (A-10) gives $$M^1/(Wd) = [Sk/(4\tan\theta)][\tau/\sigma(f)] + Sd\mu\sigma f/(8W) \quad \text{(A-24)}$$

$$= a_1[\sigma/\sigma(f)] + a_1\mu F_D\tan\theta/W_D$$

$$= a_1[E_D + \mu\tan\theta(1 - E_D)]$$

Thus if $E_D{}^1$ is defined as the dimensionless efficiency including friction $$E_D{}^1=E_D+\mu \tan \theta(1-E_D) \quad \text{(A-25)}$$

then $$T_D = a_1E_D{}^1 + a_2\sqrt{R_D} \quad \text{(A-26)}$$

$$E_D=[E_D{}^1-\mu \tan \theta]/[1-\mu \tan \theta] \quad \text{(A-27)}$$

and equations (A-26) and (A-27) replace equation (A-20).

NOMENCLATURE $a_1$, $a_2$=dimensionless constants in torque model
d=bit diameter
$E_D$=dimensionless bit efficiency
$F_D$=dimensionless tooth flat
f=tooth flat
F=penetration force on a tooth
G=side force on a tooth
k=dimensionless constant related to the number of tooth rows
M=bit torque
$M^1$=component of bit torque expended in gouging
N=bit rotation speed
R=rate of penetration
$R_D$=dimensionless penetration rate
S=bit penetration per revolution/tooth penetration
$T_D$=dimensionless torque
W=axial load on bit
$W_D$=dimensionless weight-on-bit
x=tooth penetration
TORQ=measured torque
WOB=measured weight-on-bit
ROP=rate of penetration
ROT=rate of turn (RPM)
$\tau$=effective in situ shear strength of the rock
$\sigma$=effective "penetration" strength of the rock
$\sigma$(f)=effective "penetration" strength of the rock to a blunt tooth with flat f
$\theta$=semi-tooth angle
$\mu$=friction coefficient between rock and bit teeth

What is claimed is:

1. A method of monitoring the wear of the teeth of milled tooth bits while drilling in formations that drill by a gouging and a scraping action comprising the steps of measuring the weight on the bit, the torque required to rotate the bit, and the speed of rotation of the bit;

calculating the rate of penetration R in distance drilled per unit of time;

calculating the dimensionless torque $T_D$ from the equation, $T_D$=M/Wd, where M is the measured torque, W is the weight on the bit, and d is the bit diameter using appropriate dimensions to produce a dimensionless $T_D$;

calculating the dimensionless rate of penetration $R_D$ from the equation, $R_D$=R/Nd, where R is the rate of penetration, N is the rate of rotation of the drill pipe, and d is the diameter of the bit, using appropriate dimensions to produce a dimensionless $R_D$;

empirically determining the values of constants $a_1$ and $a_2$ for a sharp drill bit by plotting $T_D$ vs $R_D$ from data collected for a sharp drill bit, with $a_1$ being the intercept of the $T_D$ axis and $a_2$ being the slope of the line through the plotted points; and determining bit efficiency from the equation $E_D=(T_D-a_2 R_D)/a_1$; and pulling the bit when the bit efficiency drops to a preselected amount.

2. A method of monitoring the wear of the teeth of milled tooth bits while drilling in formations that drill by a gouging and a scraping action comprising the steps of measuring the weight on the bit, the torque required to rotate the bit, and the speed of rotation of the bit;

calculating the rate of penetration R in distance drilled per unit of time;

calculating the dimensionless torque $T_D$ from the equation, $T_D$=M/Wd, where M is the measured torque, W is the weight on the bit, and d is the bit diameter using appropriate dimensions to produce a dimensionless $T_D$;

calculating the dimensionless rate of penetration $R_D$ from the equation, $R_D$=R/Nd, where R is the rate of penetration, N is the rate of rotation of the drill pipe, and d is the diameter of the bit, using appropriate dimensions to produce a dimensionless $R_D$;

empirically determining the values of constants $a_1$ and $a_2$ for a sharp drill bit by plotting $T_D$ vs $R_D$ from data collected for a sharp drill bit, with $a_1$ being the intercept of the $T_D$ axis and $a_2$ being the slope of the line through the plotted points;

determining bit efficiency from the equation $E_D=(T_D-a_2 R_D)/a_1$;

pulling the bit when the bit efficiency drops to a preselected amount;

calculating the dimensionless tooth flat $F_D$ by calculating the dimensionless weight on the bit $W_D$ from the equation $W_D=R_D/(4a_1E_D)$, and calculating $F_D$ from the equation $F_D=W_D(1-E_D)$.

3. The method of claim 2, further including the step of inferring the effective rock strength $\sigma$ from the equation $\sigma=2W/W_Dd^2$.

4. The method of claim 3, further including the step of inferring the apparent rock strength $\sigma$(f) to a bit with an average tooth flat f from the equation $\sigma(f)=\sigma/E_D$.

* * * * *

UNITED STATES PATENT AND TRADEMARK OFFICE

CERTIFICATE OF CORRECTION

PATENT NO. : 4,627,276

DATED : December 9, 1986

INVENTOR(S) : Trevor M. Burgess, William G. Lesso Jr.

It is certified that error appears in the above-identified patent and that said Letters Patent is hereby corrected as shown below:

Column 10, Line 25 should read --determining bit efficiency from the equation $E_D=(T_D-a_2\sqrt{R_D})/a_1$; and--

Column 10, Line 52 should read --determining bit efficiency from the equation $E_D=(T_D-a_2\sqrt{R_D})/a_1$;--

Signed and Sealed this

Twenty-second Day of November, 1988

*Attest:*

DONALD J. QUIGG

*Attesting Officer*

*Commissioner of Patents and Trademarks*